US006810812B2

(12) United States Patent
Fischer

(10) Patent No.: US 6,810,812 B2
(45) Date of Patent: Nov. 2, 2004

(54) METHOD FOR REGULATING THE TENSION OF A WEB

(75) Inventor: Michael Heinz Fischer, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 36 days.

(21) Appl. No.: 10/312,596

(22) PCT Filed: Jul. 19, 2001

(86) PCT No.: PCT/DE01/02717

§ 371 (c)(1),
(2), (4) Date: May 21, 2003

(87) PCT Pub. No.: WO02/07974

PCT Pub. Date: Jan. 31, 2002

(65) Prior Publication Data

US 2003/0188661 A1 Oct. 9, 2003

(30) Foreign Application Priority Data

Jul. 22, 2000 (DE) ..... 100 35 787

(51) Int. Cl.[7] ..... B41F 13/54; B65H 23/18

(52) U.S. Cl. ..... 101/485; 101/216; 101/228; 101/247; 101/248; 226/31; 226/44; 226/92; 226/195

(58) Field of Search ..... 101/488, 485, 101/DIG. 42, 216, 219, 220, 247, 248, 228, 484, 142; 226/31, 44, 92, 195; 318/6, 7; 700/122

(56) References Cited

U.S. PATENT DOCUMENTS

| | | | | | |
|---|---|---|---|---|---|
| 4,264,957 | A | * | 4/1981 | Pautzke | 101/248 |
| 4,960,048 | A | * | 10/1990 | Sarda | 101/247 |
| 5,010,816 | A | * | 4/1991 | Sarda | 101/228 |
| 5,791,541 | A | * | 8/1998 | Jitsuishi et al. | 226/44 |
| 5,937,756 | A | * | 8/1999 | Kishine et al. | 101/228 |
| 5,983,793 | A | * | 11/1999 | Volz et al. | 101/216 |
| 6,050,185 | A | * | 4/2000 | Richards | 101/142 |
| 6,092,466 | A | * | 7/2000 | Koch | 101/485 |
| 6,106,177 | A | * | 8/2000 | Siegl et al. | 101/228 |
| 6,213,016 | B1 | * | 4/2001 | Tsunashima | 101/247 |
| 6,321,650 | B1 | * | 11/2001 | Ogawa et al. | 101/485 |
| 6,345,574 | B1 | * | 2/2002 | Charette et al. | 101/247 |

FOREIGN PATENT DOCUMENTS

| | | |
|---|---|---|
| DE | 42 11 379 A1 | 10/1993 |
| DE | 197 53 820 A1 | 6/1999 |
| DE | 199 18 399 A1 | 11/1999 |
| EP | 0 951 933 A1 | 10/1999 |
| GB | 2 331 961 A | 6/1999 |

* cited by examiner

*Primary Examiner*—Eugene H. Eickholt
(74) *Attorney, Agent, or Firm*—Jones, Tullar & Cooper PC

(57) ABSTRACT

The tension of a web in a rotary printing press is regulated during passage of the web between at least first and second cylinders of at least one printing group. The two cylinders are driven using at least one drive mechanism. A distance between the two cylinders is varied to influence the web tension before, between and after the printing groups.

21 Claims, 3 Drawing Sheets

METHOD FOR REGULATING THE TENSION OF A WEB

FIELD OF THE INVENTION

The present invention is directed to a method for regulating a web tension. The web is stretched between a pair of cylinders. The two cylinders interact with each other through the web.

BACKGROUND OF THE INVENTION

A registration-maintaining drive mechanism for a rotary printing press is known from EP 0 951 993 A1. A longitudinal stretching of the web of material to be imprinted is determined from the web tension values and operating values of the drive mechanisms. This longitudinal stretching is compensated for by adjusting the circumferential registration at the cylinders or the registration rollers.

Printing groups are disclosed in DE 42 11 379 A1, whose rubber blanket cylinders are seated in adjustable eccentric bushings. The contacting of the rubber blanket cylinders is varied by pivoting around the first eccentric axis. A variation of the printing width of an ink application roller with respect to the screen roller is provided by pivoting around the second eccentric axis.

SUMMARY OF THE INVENTION

The object of the present invention is directed to providing a method for regulating a web tension.

In accordance with the present invention, this object is attained by stretching the web between a pair of cylinders that interact with each other via the web. A change in the distance between the two cylinders is used to regulate the web tension. An actual value of a parameter that defines the relationship of the tension in the web before and after the cylinders is measured and is compared with a set point. A deviation between the two is used to change the distance between the cylinders.

The advantages to be gained by the method of the present invention consist, in particular, in that the printing groups, or print units, can be regulated in a simple manner via the existing tensile stress, or tension, of the web, for example the web of material to be imprinted or the paper web. This is achieved by changing the pressure feed adjustment between the cylinders which interact with each other via the web. In an advantageous manner this is accomplished with "rubber against rubber pressure" of the two interacting transfer cylinders of a printing group.

The conveying behavior of a web through a printing press is subjected to many influences, such as, for example, the tension/stretching characteristics of the respective paper, and therefore the prevailing tension, the instantaneous moisture of the web, the sensitivity of the web to moisture, the penetration behavior of moisture into the web, the position of the roll while being produced on the reel spool which, for example, finds its expression in variations of the winding hardness, and location-dependent variations in the modulus of elasticity of the web. Besides this, the conveying behavior of a web is also a function of the dressing and of the contact pressure.

By utilization of the method in accordance with the present invention, it is possible, in an advantageous manner, to affect the conveying behavior of the web through one or several printing groups of the printing press and to regulate it without requiring a change of rubber blankets to ones of different thickness, or requiring a change in running the process, for example a change of dampening. A change in the tension of the web can be counteracted during the printing process by changing the conveying behavior. The employment of different rubber blankets or different types of paper is also possible, since by use of the method of the present invention, the conveying behavior and the print quality can be changed by changing the distance rather than by changing the thickness of the rubber blankets.

In a reversed method, it is possible to use rubber blankets with different conveying behavior, of different quality and/or of different thickness, wherein the desired web tension, or graduation of the web tension between the printing groups can be automatically maintained almost constant.

Rubber blankets from certain manufacturers act in a "negatively conveying manner", for example, the web is braked. Rubber blankets from other manufacturers act in a "positively conveying manner", the web is "pushed along" in addition to it undergoing an unwinding at the nip location.

The conveying behavior of the web is also a function of the contact pressure between the rubber blankets and the paper web.

In a preferred embodiment of the present invention, the transfer cylinders are driven in pairs by their own drive mechanism. The forme cylinders interacting with the transfer cylinders, as well as with ink and dampening units, are embodied to be individually driven and are only electrically synchronized with the transfer cylinders. The advantages resulting from this are, among others, the avoidance of gear tooth play, which occurs in case of a mechanical coupling of the transfer and forme cylinders, for example, and an almost torsion-proof and angle-synchronous driving of the forme cylinders with respect to the transfer cylinders. Further than that, fluctuations of torque, caused for example by distributing rollers or siphon ink units, are damped by the separate drive mechanisms for the forme cylinders, together with their associated ink and dampening units, and are not transmitted to the transfer cylinders. This results in a printing process which is undisturbed to a great extent.

BRIEF DESCRIPTION OF THE DRAWINGS

A preferred embodiment of the present invention is represented in the drawings and will be described in greater detail in what follows.

Shown are in.

DESCRIPTION OF PREFERRED EMBODIMENTS

Figure 1:
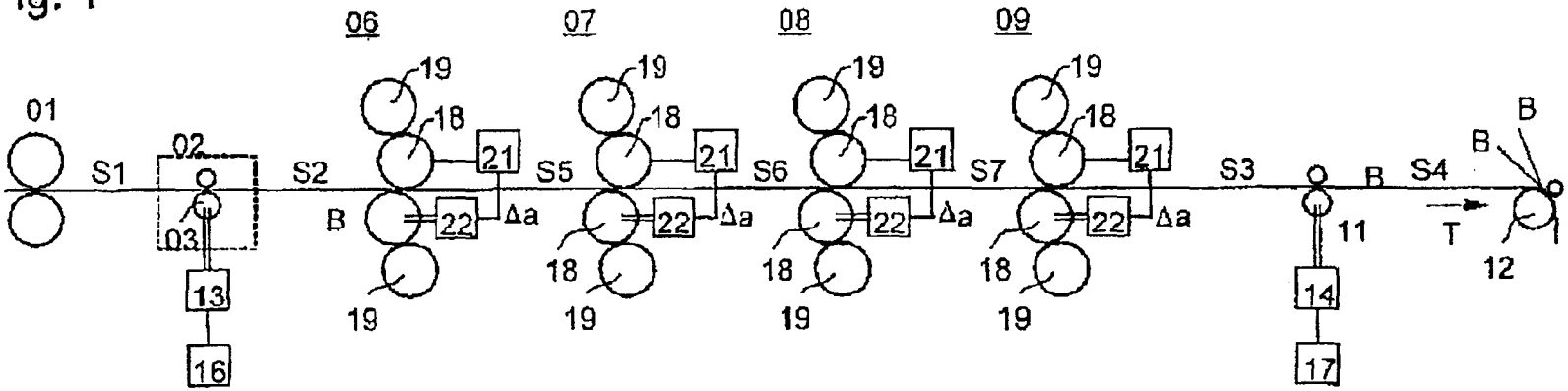
FIG. 1 is a schematic representation of the path of a web from a draw-in unit over four printing groups and a second traction roller up to a hopper inlet roller in accordance with the present invention.

A path of travel of a web B, for example a web B of a material to be imprinted, or a paper web B, on its way through a printing press, and in particular through a web-fed rotary printing press, is represented in FIG. 1. The web B runs in the conveying direction T from the roll changer 01 through a web draw-in unit 02 with a first traction roller 03; through, for example, printing groups 06 to 09, and to a second traction roller 11. Turning bars, cutters, additional traction or guide rollers, and finally the hopper inlet roller, for example, are all not represented, and are understood to follow behind or after, in the direction T, the second traction roller 11. The essential first and second traction rollers 03, 11 are each preferably equipped with their own drive mechanisms 13, 14 and are each preferably also equipped with a drive control device 16, 17. In a preferred embodiment, the tensions S1, S2, S3, S4 in the web B are measured upstream of the draw-in unit 02, between the draw-in unit 02 and the first printing group 06, as well as between the last printing group 09 and the second traction roller 11, and on the free path between the second traction roller 11 and the hopper inlet roller 12. This can be done, for example, by using measuring rollers or by measuring the power consumption of the drive motors of the traction units.

If, particularly during a multi-web operation, several webs B are being combined at the hopper inlet by use of the hopper inlet roller 12, the base points for adjusting the tensions in the resultant web B are the absolute and relative tensions S4 of the individual webs B in respect to each other at the hopper inlet roller 12. It is noted that several webs B are indicated in FIG. 1. Accordingly, the adjustment of the tensions in the resultant web B takes place starting with the desired level in the several webs B at the hopper inlet roller 12. The base level of the tension in each web B is preferably set by an adjustment at the draw-in unit 02. A change of the level of the tension in the web B also takes place in an advantageous manner by changing the tension S2 at the draw-in unit 02. For stretching the web B, the first traction roller 03 is operated lagging behind the press speed. During the production run, i.e. at printing speed and with the addition of water and/or ink, the second traction roller 11 is, as a rule, operated at a higher speed than the press speed of the rotating cylinders 18, for example the transfer cylinders 18.

For the production run at production speed, the first and second traction rollers 03, 11, respectively as well as the hopper inlet roller 12, and possibly those drive mechanisms located between the second traction roller 11 and the hopper inlet roller 12, can be regulated in respect to speed, torque or rotational position. The first traction roller 03, in particular, can be regulated in such a way that the web tension S2 between the draw-in unit 02 and the first printing group 08 is continuously returned to a set point.

For running a dry web B, it is advantageous if ahead of the first printing group 06 and downstream of the last printing unit 09, as well as between the printing units 06 to 09, the same tensions S2 and S3, or S5 to S7, of the web B prevail.

With the addition of water and/or ink to the web B, the tension or stretching behavior, as well as the conveying behavior of the web B, changes during its passage through the individual printing stations of the printing groups 06 to 09.

Figure 2:
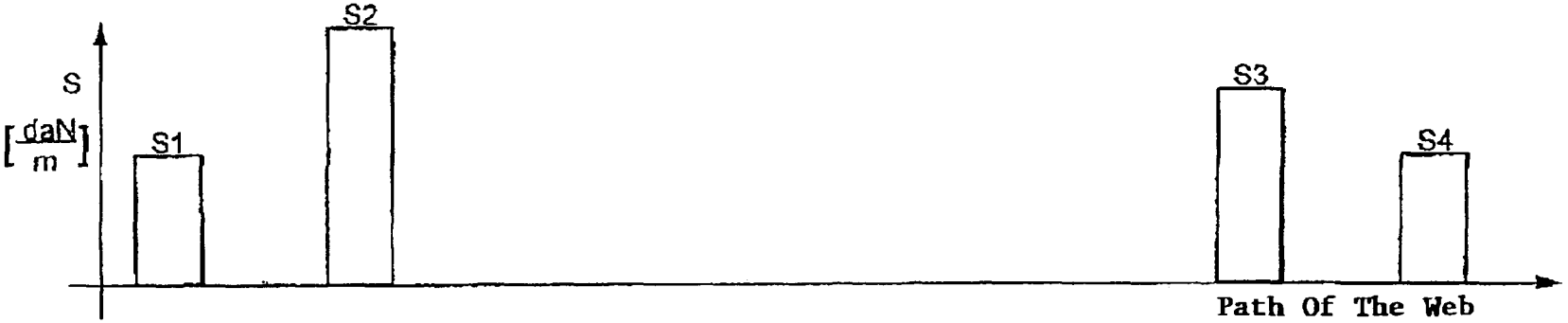
FIG. 2 is a schematic representation of the tension in the web during the production run.

As schematically represented in FIG. 2, during the production run, a basic setting of the tensions S2 and S3 of the web B ahead of the first printing group 06 and following the last printing group 09 is provided by application of customary control and regulating techniques, for example by operation of the traction roller 03, which is regulated as to web tension, speed or position, by the also regulated hopper inlet roller 12 and/or by compensating rollers, which are not specifically represented. This state of the web B which, as a rule is tension-regulated, also takes into consideration a change in the length of the web B, which change in length takes place after and during the passage of the web B through the printing groups 06 to 09 because of the effects of moisture, by operation of the lagging of the first traction roller 03 and a speed-up of the second traction roller 11 in respect to the press speed. It is also possible to take symmetrical and stationary fan-out formations in the transverse registration into consideration here.

The conveying behavior and the tension S5 to S7 of the web B between the printing groups 06 to 09 also changes if the print-on position is assumed and water and ink are added; when a change to another type of paper is made; or when process parameters, such as the addition of the dampening agent amount, for example, are changed. In the course of the web B passing through several printing groups 06 to 09, a considerable change in the paper properties can take place in the continuing travel of the web B in the conveying direction T, which in turn causes a difference in the conveying behavior of the web B in its travel through the printing groups, for example through printing groups 06 to 09. Thus, for example, depending on the type of paper and the free path length between the printing groups 06 to 09, the moisture may have already completely penetrated the web B, partially even before the web B reaching the third printing location, in this case the third printing block 08, for example.

Figure 3:
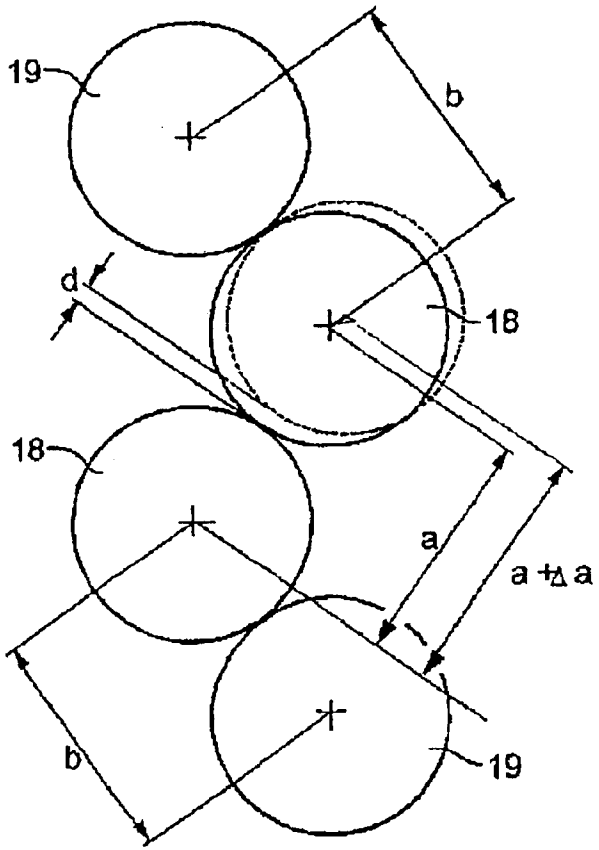
FIG. 3 is a schematic representation of a rubber-against-rubber printing group without the representation of the ink unit or possibly the dampening unit, FIG. 4, a schematic representation of a second preferred embodiment of the present invention with a rubber blanket/counter-pressure cylinder printing group without the representation of the ink unit or possibly the dampening unit.

In order to counteract the changes or fluctuations in the conveying behavior and/or the changes in the tension S5 to S7 of the web B in the course of the web B passing through the printing groups 06 to 09 during the production run, the distance "a" between the two cylinders 18 of each printing group 06, 07, 08, 09, which interact with each other via the web B, can be changed, as depicted in FIG. 3. This can take place in such a way that a detent for the print-on position can be changed. The web B extends between the cylinders 18, which can be moved radially in respect to each other over a distance "a", and in the print-on position the web B is stretched between them. The two cylinders 18, whose distance "a" in relation to each other can be changed, represent two transfer cylinders 18 during rubber-against-rubber printing. This change of the distance "a" between the two interacting transfer cylinders 18, for example over a distance $\Delta a$, is preferably performed in such a way that at the same time a distance "b" between the transfer cylinder 18 and a cylinder 19, for example a forme cylinder 19 interacting with it, is retained.

Customarily the print-on, or print-off position of the transfer cylinder 18 and forme cylinder 19 in relation to each other is achieved by the pivoting of eccentric bushings, which receive the journals of the transfer cylinder 18 or forme cylinder 19. The change of the distance "a" can, for example, take place by use of a second device, wherein the change of the distance "a" must not result in a change of the distance "b". This can be achieved, for example, by use of a second eccentricity of the eccentric bushings receiving the journals. However, it is also possible, for example, to use a paper thickness adjustment already provided on the press for this change. With a suitable arrangement of the respective transfer cylinders 18 and forme cylinders 19 in relation to each other, an approximately linear displacement of one of the transfer cylinders 18 is also conceivable. The change in the distance "a" is preferably performed by the setting of a second eccentric bushing at one of the two interacting transfer cylinders 18, as indicated in FIG. 3, which is depicted in a greatly overdrawn manner. Setting of the distance "a", in the example the setting of the second eccentric bushing, takes place by the use of a setting member 21, for example in a hydraulic, pneumatic, mechanical, electrical manner or combination thereof.

The described change in the conveying behavior by varying the distance "a" by a change Δa takes place only in the area in which the web B is still stretched between the transfer cylinders 18, i.e. is conveyed. Thus, this regulation of the tension of the web B and of the conveying behavior takes place in the print-on position of the interacting transfer cylinders 18. In the print-on position, a print gap "d" between the surface areas of the two transfer cylinders 18 interacting with each other through the interposed web B is less in every phase, or at most is equal to the thickness of the web B at the corresponding location.

If now a change in the conveying behavior of the web B occurs at one or at several of the printing groups 06 to 09, a change of the distance "a", for example by the amount of the change Δa, is possible, which results in an increase or decrease of the printing gap "d". Setting of the setting member 21, and therefore the change Δa of the distance "a", can be performed by the operator himself, for example from a control console, by use of a value for the change Δa as the setting value Δa transmitted to the setting member 21, or at the printing group by actuating an appropriate key. For example, the setting member 21 displaces a detent against which the respective transfer cylinder 18 has been placed in the print-on position. Thus, during the production run, the operator can affect the conveying behavior of the web B between the printing groups 06 to 09 while the production is running.

In a preferred embodiment of the present invention, the regulation of the conveying behavior of the web B between the printing groups 06 to 09 takes place automatically and has been integrated into a regulation concept for the tension of the web B, for example, which regulates the tension and stretching ahead of the first printing group 06 and following the last printing group 09 for compensating changes in the stretching of the web B on account of changes of the properties of the paper.

The regulation of the conveying behavior of the web B in, or between the printing groups 06 to 09 takes place, in an advantageous manner, by use of parameters of the drive mechanisms 22. An actual value $X\text{-}Ist_1$ of a parameter $X\text{-}Ist_i$ is measured at the drive mechanism 22 in the printing group i and is compared with a set point $X\text{-}SollI_i$. A deviation $\Delta_i$ is used for regulating, and if required changing, the distance "a" between the cylinders 18. The drive mechanism 22 of the transfer cylinders 18 is preferably regulated to a constant circumferential speed, or angular speed.

Preferably, the regulation of the conveying behavior of the web B in, or between the printing groups 06 to 09 takes place by means of the power consumption $P\text{-}Ist_i$ for the printing group i of the drive mechanisms for the cylinders 18 interacting with the web B, in the example the transfer cylinders 18. In order to keep the influence of the forme cylinders 19, and possibly of the ink and/or dampening units, which are not specifically represented, mechanically coupled with them, as low as possible in the course of the measurement of the power consumption, the two transfer cylinders 18 for each printing group 06 to 09 are preferably driven in pairs by their own drive mechanisms 22, and the forme cylinders 19, together with the associated ink and possibly dampening units, interacting with them are driven by their own drive mechanisms, which are not specifically depicted. In one embodiment of the present invention, each pair of transfer cylinders 18 is coupled mechanically, for example by the use of gear wheels or belts. However, every transfer cylinder 18 can be individually driven and electronically synchronized. A change in the tension, or the conveying behavior, results in a change of the power consumption $P\text{-}Ist_i$ of the drive mechanisms 22, which are preferably rpm-controlled.

Figure 5:
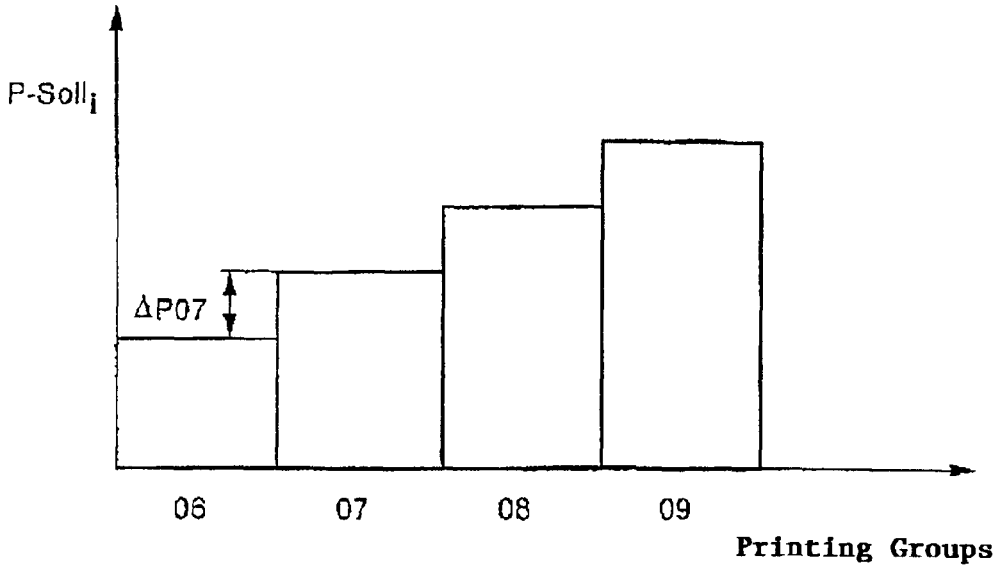
FIG. 5 is the dependence of the set points for the power consumption of the drive mechanisms for the transfer cylinders driven in pairs by way of example, and in FIG. 6 is a schematic representation of the control circuit for a printing group i.

Provided that it is appropriately standardized, the power consumption $P\text{-}Ist_i$ by the drive mechanisms 22 of a pair of cylinders 18 interacting with the web B is a measure of the work performed per unit of time by the drive mechanisms 22, and, in turn, represents a measure of the relations of the tensions S2, S5, S6, S7, S3 ahead of and following the cylinders 18, as well as of the conveying behavior of the web B. Accordingly, set points $P\text{-}SollI_i$, for printing group i, for the power consumption of the drive mechanism 22 are fixed for the successive printing groups 06 to 09. As a rule, these differ from each other for the printing groups 06 to 09 which are being passed one after the other in the conveying direction T of the web B, as seen in FIG. 5. In the example, these set points $P\text{-}SollI_i$ rise from the first printing group 06 with $P\text{-}SollI_{06}$ of approximately 4 kW to the fourth printing group 09 with $P\text{-}SollI_{09}$ of approximately 7 kW. However, it is possible to preset as set points also set points $\Delta P_{ij}$=SollI of the power consumption of the respective differences $\Delta P_{ij}$= $P\text{-}Ist_i$, $P\text{-}Ist_j$, between two successive printing groups i and j, for example $\Delta P_{07,08}$=1 kW.

Figure 6:
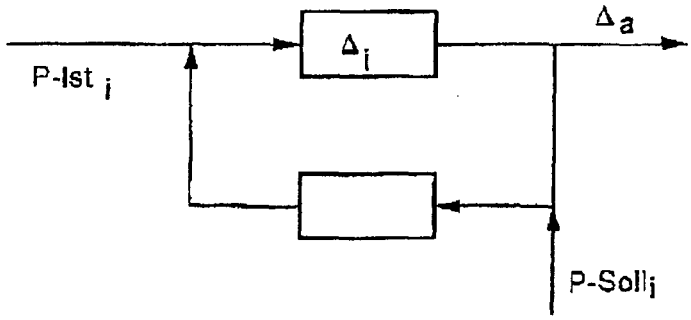

The instantaneous power consumption $P\text{-}Ist_i$ is compared with the respective set point $P\text{-}SollI_i$, or the differences $\Delta P_{ij}$ with the set point $\Delta P\text{-}_{ij}\text{-}SollI$. If a deviation $\Delta_i$, or $\Delta_{ij}$ from the set point $P\text{-}SollI_i$, or $\Delta P_{ij}\text{-}SollI$ is measured, this is processed in the control circuit, as schematically indicated in FIG. 6, and a change of the distance "a" by the value Δa is effected via the setting member 21. This results in a larger, or lesser, print gap "d", or rubber blanket projection between the two interacting transfer cylinders 18, and therefore a changed conveying behavior of the web B in the respective printing group i, with i as 06, 07, 08, 09. Now the changed conveying behavior of the web B itself changes the power consumption $P\text{-}Ist_i$ of the drive mechanism of the i-th printing group. This power consumption $P\text{-}Ist_i$, is monitored and returned to the control circuit.

Other suitable parameters of the drive mechanisms 22 can also be used for regulating the printing gap "d" in the print-on position, i.e. when the web B is stretched between the transfer cylinders 18 and is therefore being conveyed. It is also possible to use measured values of the tension S5 to S7 between the printing groups 06 to 09 for regulating the distance "a", or the printing gap "d". However, the use of already existing output data is advantageous, since this requires less additional outlay.

Figure 4:
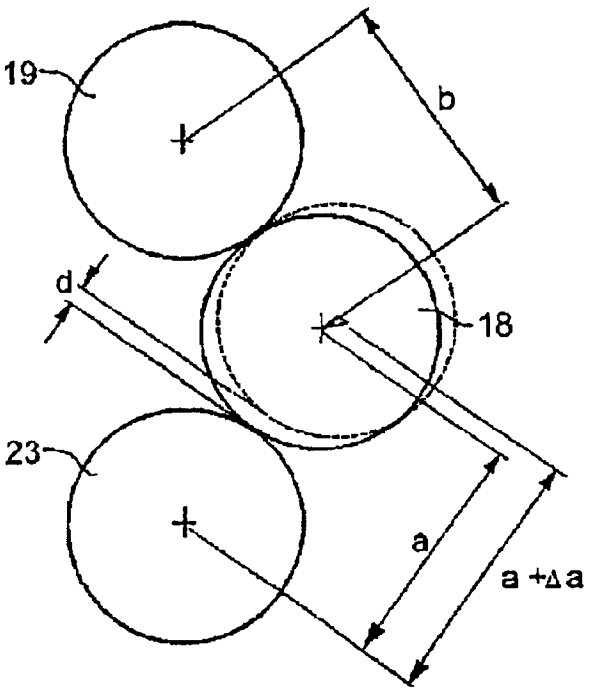

In the case of transfer cylinders 18, and counter-pressure cylinders 23 controlled to a constant moment, as seen in the second embodiment which is shown in FIG. 4, the parameter can be the angular speed, for example, which changes when tension or conveying behavior changes. It is now possible to counteract this change again by changing the distance "a".

If the transfer cylinder 18 does not interact through the web B with a second transfer cylinder 18, but instead with a counter-pressure cylinder 23, as seen in FIG. 4, the transfer cylinder 18 is placed against the counter-pressure cylinder 23 by the web B, or vice versa, for the print-on position. To change the tensions S5 to S7, the distance "a" between the transfer cylinders 18 and the interacting counter-pressure cylinder 23 is changed. Both cylinders 18, 23 interacting with each other through the web B, for example two rubber blanket cylinders 18, or one rubber blanket cylinder 18 and one counter-pressure cylinder 23, can be moved for changing the distance "a". The described method also includes variants wherein one counter-pressure cylinder 23 interacts with two or more transfer cylinders. Changes of the respective tension of the web B in the print-on position take place in that the distance "a" between the counter-pressure cylinder 23 and the rubber blanket cylinder 18 is varied.

The two cylinders 18, 23, interacting through the web B and stretching the latter, can also be arranged at another location of a printing press, in a paper-making machine or a rolling mill, for example in a lacquering arrangement, a dryer, a superstructure of a painting or rolling arrangement, a calender, or other installations in which a web B is guided.

A change of the tension relationships, or a change in the conveying behavior are detected by use of a parameter which defines the tension conditions. It can also be a value other than the power consumption $P\text{-}Ist_i$, for example a change of the angular speed in the case of cylinders 18, 23 which are controlled in respect to a constant moment, or also a direct measurement of the tension. The change of this value represents a measure of the values "tension" and "conveying behavior", which mutually affect each other. In particular, it identifies a change of the relationships of the tension S2, S3, S5, S6, S7 of the web B ahead of and following the printing groups 06, 07, 08, 09, or a change in the resultant conveying behavior. The deviation of the value characterizing the tension relationships from the set point $X\text{-}SolI_i$ is now used for changing the distance "a" between the cylinders 18, 23, which affects the conveying behavior of the web B.

In this way, the printing groups 06, 07, 08, 09 can be controlled to an approximately constant tension S2, S3, S5, S6, S7 of the web B ahead of, following and/or between the printing groups 06, 07, 08, 09.

While preferred embodiments of a method for regulating the tension of a web in accordance with the present invention have been set forth fully and completely herein above, it will be apparent to one of skill in the art that changes in, for example the number of printing groups, the structure of the folding hopper and the like can be made without departing from the true spirit and scope of the present invention which is accordingly to be limited only by the appended claims.

What is claimed is:

1. A method for regulating a tension of a web including:

providing a first cylinder and a second cylinder interacting with said first cylinder through the web;

positioning said first cylinder and said second cylinder in a web engaging print-on position;

providing a print-on distance between said first cylinder and said second cylinder in said print-on position;

selecting said print-on distance not more than a thickness of the web in said print-on position;

stretching the web between said first cylinder and said second interacting cylinder using said print-on distance in said print-on position; and changing said print-on distance between said first and second cylinders for regulating a tension in the web.

2. The method of claim 1 further including measuring an actual value of a parameter defining a relationship of a tension in the web before and after said first and second cylinders, providing a set point of said parameter, determining a deviation of said actual value from said set point, and changing said distance based on said deviation.

3. The method of claim 2 further including providing a least one drive mechanism for said first and second cylinders.

4. The method of claim 3 further including determining said actual value at said drive mechanism.

5. The method of claim 1 further including arranging said first and second cylinders in a printing group of a printing press.

6. The method of claim 4 further including using a power consumption of said drive mechanism as said actual value and presetting said set point as the set point of said power consumption.

7. The method of claim 5 further including providing said first and second cylinders as transfer cylinders and providing a common drive mechanism for driving said first and second cylinders.

8. The method of claim 7 further including providing a forme cylinder interacting with each of said transfer cylinders and further mechanically decoupling each said forme cylinder from said common drive mechanism.

9. The method of claim 5 further including providing said first cylinder as a transfer cylinder having a drive mechanism and providing said second cylinder as a counter-pressure cylinder and further providing a forme cylinder interacting with said transfer cylinder, said forme cylinder being mechanically decoupled from said drive mechanism of said transfer cylinder.

10. The method of claim 9 further including changing a distance between said transfer cylinder and said counter-pressure cylinder.

11. The method of claim 10 further including maintaining a distance between said transfer cylinder and said forme cylinder constant.

12. A method for regulating a tension of a web including:

providing a first cylinder and a second cylinder interacting with said first cylinder through the web;

providing a distance between said first cylinder and said second cylinder;

stretching the web between said first cylinder and said second interacting cylinder;

measuring an actual value of a parameter defining a relationship of a tension in the web before and after said first and second interacting cylinders;

providing a set point for said value of said parameter;

measuring a deviation of said actual value from said set point; and changing said distance between said first cylinder and said second cylinder in accordance with said deviation.

13. The method of claim 12 further including providing a least one drive mechanism for said first and second cylinders.

14. The method of claim 13 further including determining said actual value at said drive mechanism.

15. The method of claim 12 further including arranging said first and second cylinders in a printing group of a printing press.

16. The method of claim 14 further including using a power consumption of said drive mechanism as said actual value and presetting said set point as the set point of said power consumption.

17. The method of claim 15 further including providing said first and second cylinders as transfer cylinders and providing a common drive mechanism for driving said first and second cylinders.

18. The method of claim 17 further including providing a forme cylinder interacting with each of said transfer cylinders and further mechanically decoupling each said forme cylinder from said common drive mechanism.

19. The method of claim 15 further including providing said first cylinder as a transfer cylinder having a drive mechanism and providing said second cylinder as a counter-pressure cylinder and further providing a forme cylinder interacting with said transfer cylinder, said forme cylinder being mechanically decoupled from said drive mechanism of said transfer cylinder.

20. The method of claim 19 further including changing a distance between said transfer cylinder and said counter-pressure cylinder.

21. The method of claim 20 further including maintaining a distance between said transfer cylinder and said forme cylinder constant.

* * * * *